US012330026B2

(12) United States Patent
Choffat et al.

(10) Patent No.: US 12,330,026 B2
(45) Date of Patent: Jun. 17, 2025

(54) BASE PLATE FOR A SWIMMING STARTING BLOCK, AND BASE PLATE AND STARTING BLOCK SET

(71) Applicant: Swiss Timing Ltd, Corgemont (CH)

(72) Inventors: Frederic Choffat, Alle (CH); Christophe Grasso, Bienne (CH); André Zanetta, Wavre (CH); Lukas Holzer, Studen (CH)

(73) Assignee: Swiss Timing Ltd, Corgemont (CH)

( * ) Notice: Subject to any disclaimer, the term of this patent is extended or adjusted under 35 U.S.C. 154(b) by 406 days.

(21) Appl. No.: 17/805,271

(22) Filed: Jun. 3, 2022

(65) Prior Publication Data

US 2023/0390625 A1 Dec. 7, 2023

(51) Int. Cl.
*A63B 5/10* (2006.01)

(52) U.S. Cl.
CPC ..... *A63B 5/10* (2013.01); *A63B 2220/51* (2013.01); *A63B 2220/803* (2013.01); *A63B 2220/833* (2013.01)

(58) Field of Classification Search
CPC ... A63B 71/0605; A63B 5/10; A63B 24/0062; A63B 2220/51; A63B 2220/803; A63B 2220/833; A63B 2220/62; A63B 2225/50; A63B 2244/20; G07C 1/24; G07C 1/22; A63K 3/02
See application file for complete search history.

(56) References Cited

U.S. PATENT DOCUMENTS 3,302,007 A * 1/1967 Parkinson ..... G07C 1/24 377/5
3,745,275 A * 7/1973 Degiez ..... A63B 71/0605 200/86 R
3,916,214 A * 10/1975 Coble, Jr. ..... A63B 71/0605 307/119
4,194,101 A * 3/1980 Berseth ..... A63B 71/0605 200/86.5
5,901,961 A * 5/1999 Holland, III ..... G07C 1/22 273/445
7,265,588 B2 * 9/2007 Chang ..... G06F 1/324 326/38
7,344,482 B2 * 3/2008 Checketts ..... A63B 1/00 482/111

(Continued)

OTHER PUBLICATIONS

Kistler, Performance Analysis System for Swimming Starts, Turns and Relay Changeovers, 2019, 3 pages, retrieved from the internet: <https://kistler.cdn.celum.cloud/SAPCommerce_Download_original/003-134e.pdf> (Year: 2019).*

*Primary Examiner* — Megan Anderson
*Assistant Examiner* — Kathleen M Fisk
(74) *Attorney, Agent, or Firm* — Oblon, McClelland, Maier & Neustadt, L.L.P.

(57) ABSTRACT

A base plate is to be fixed to the ground at the edge of a swimming pool. A starting block can be fixed on the base plate. The base plate includes in an inner cavity, measurement electronics with at least one force or motion sensor or at least one strain gauge, to provide a measurement signal to a processor processing unit of an electronic circuit to determine one or more race parameters to be stored in a memory of the electronic circuit and/or to transmit wirelessly or wired to the base station or a timing station.

9 Claims, 2 Drawing Sheets

(56) References Cited

U.S. PATENT DOCUMENTS

| | | | | |
|---|---|---|---|---|
| 7,946,928 | B2 * | 5/2011 | Mooney | A63B 69/3614 473/266 |
| 9,168,420 | B1 * | 10/2015 | Berme | A61B 5/1036 |
| 9,526,451 | B1 * | 12/2016 | Berme | A61B 5/486 |
| 10,245,524 | B2 * | 4/2019 | Stockinger | A63K 3/02 |
| 10,335,638 | B2 * | 7/2019 | Gasser | A63B 69/12 |
| 10,391,416 | B2 * | 8/2019 | Stockinger | A63B 69/12 |
| 10,653,935 | B2 * | 5/2020 | Galli | A63K 3/023 |
| 10,732,700 | B2 * | 8/2020 | Murtagh | G06F 1/12 |
| 11,850,050 | B2 * | 12/2023 | Shield | A63B 21/4015 |
| 2012/0192346 | A1 * | 8/2012 | Maas | A63B 5/10 4/496 |
| 2017/0036067 | A1 * | 2/2017 | Gasser | E04H 4/14 |
| 2022/0347540 | A1 * | 11/2022 | Spannuth | G09B 19/0038 |
| 2023/0117056 | A1 * | 4/2023 | Grasso | A63B 69/12 4/496 |
| 2024/0238647 | A1 * | 7/2024 | Graham | G06F 17/18 |

* cited by examiner

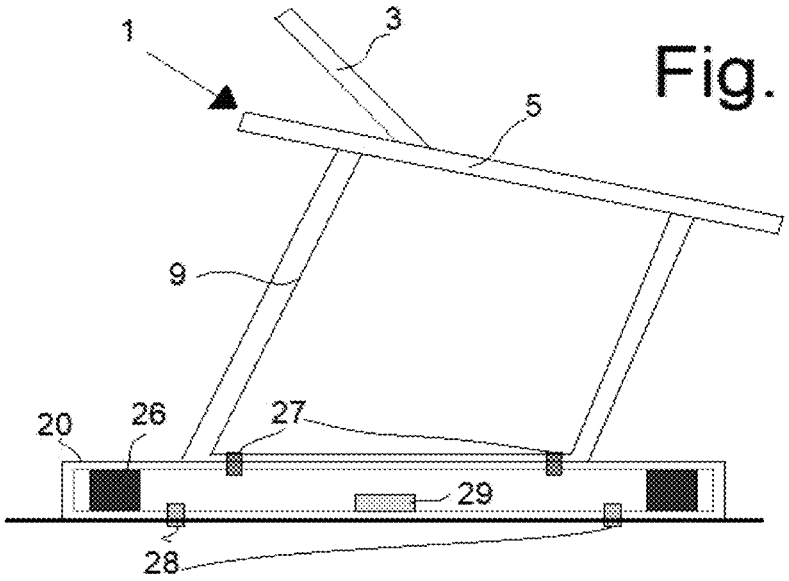
Fig. 3a
Fig. 3b
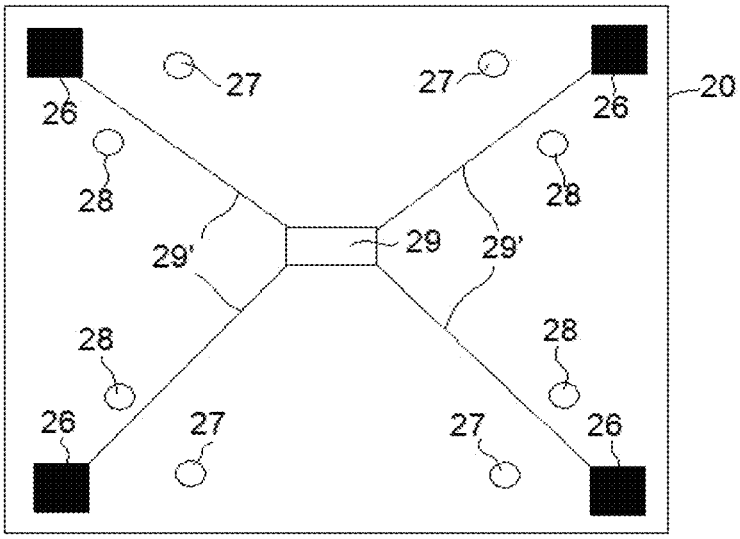

BASE PLATE FOR A SWIMMING STARTING BLOCK, AND BASE PLATE AND STARTING BLOCK SET

FIELD OF THE INVENTION

The invention relates to a base plate for a swimming starting block. The base plate is fixed to the ground at a starting point of the swimming race on a race lane.

The invention also relates to a base plate and starting block assembly.

BACKGROUND OF THE INVENTION

For a swimming race, starting blocks or aids are provided respectively disposed at each race lane, often in numbers of 10 lanes. Each swimming starting block is particularly adapted to a type of swimming race during a competition. The starting blocks are all disposed on the same line at the edge of one side or two opposite sides of the swimming pool. The swimmer is supported on an upper platform of the starting block for a crawl-type, breaststroke-type or butterfly-type race. For these stroke types, they can be supported on a front portion of the starting block, which is defined as a nose or also on an inclined push-off plane disposed to the rear of the platform.

However, for a backstroke-type swimming race, each swimmer must first enter the water and position themselves near a contact plate used for the race finish. This contact plate is mounted against a vertical wall of the swimming pool below the starting block. For this type of backstroke race, the swimmer can manually adjust a supporting ledge device so as to place their feet before the start on a supporting ledge plate in the water. In addition, the starting block can further comprise on the front a structure in the form of bars, fixed to the base of the starting block. This structure of bars in the form of stirrups makes it possible for the swimmer to hold on with their hands while having their feet supported by the supporting ledge plate to position themselves before the start of the race.

FIG. 1 shows a traditional starting block or aid 1. The starting block 1 comprises a platform 5 and an inclined plane 3 to the rear of the platform 5, and a base 9 for fixing to the ground the starting block 1 at the edge of the swimming pool. The starting block 1 also comprises a structure in the form of bars 7 fixed to the base 9 or to the platform 5 on the base 9 of the starting block 1 for a backstroke swimming race.

The starting block 1 can measure the reaction time with the aid of a mechanical contact to generate a signal. This mechanical contact is positioned in the starting platform 5. A movement to the rear produces a contact between two conductive portions when the swimmer leaves the starting block 1. Sensors can also be used instead of mechanical contacts on the platform. These sensors are also on the upper platform 5 and are connected to a processor processing unit to determine the variations of movement in order to in particular signal any false start.

One drawback of such an arrangement of the starting block 1 with motion sensors lies in the fact that the motion sensors must be mounted in the platform 5 which complicates the construction of such a starting block 1 and by providing the electrical connections to supply power or provide results outwardly of the starting block 1.

The patent JP3748945B2 describes a starting block with sensors or contactors disposed under the platform to detect any movement of the swimmer on the platform up to the moment of departure of the swimmer. It is difficult to pair all of the sensors or contacts so as to correctly determine the variations of movement to detect for example any false start.

SUMMARY OF THE INVENTION

Therefore, the aim of the invention is to overcome the drawbacks of the aforementioned prior art by proposing a base plate for a swimming starting block. The base plate is fixed to the ground at a starting point of the swimming race on a swimming lane and a starting block can be easily fixed on said base plate. The base plate can also comprise electronics for measuring or detecting in particular any false start more easily electrically connectable to the outside.

To this end, the invention relates to a base plate for a starting block.

One advantage of the base plate lies in the fact that above the base plate any type of starting block can be mounted without needing to have measuring functions for simplicity for low-level competitions. On the other hand, in the case of a high-level swimming competition, there is only the base plate with its measurement electronics, which is disposed or changed below the standard starting block.

Advantageously, with a base plate equipped with electronics for measuring various parameters, this makes it possible to measure the movement of a swimmer for a crawl-type, breaststroke-type, butterfly-type swimming competition, as well as for a backstroke swimming competition, which was not the case with an arrangement of sensors under a platform of the starting block.

Advantageously, with the sensors used in the base plate, this makes it possible to be more sensitive and flexible with an algorithm used to detect the departure of the swimmer. In addition, this makes it possible to be able to also detect departures of children on the starting block.

Advantageously, the base plate makes it possible to have good compatibility with existing swimming pools relating to the fixing by screws of the base plate to the ground to position the starting blocks. It is also possible to install a starting block that does not comply with the current regulations relating to the positions of screws.

Advantageously, the starting block is simpler and more robust with the starting platform that is designed without movement portion as all of the electronics for measuring various parameters are now located in the base plate fixed to the ground.

To this end, the invention also relates to an assembly comprising the base plate and the starting block.

BRIEF DESCRIPTION OF THE DRAWINGS

The aims, advantages and features of the base plate for a starting block will become clear in the following description based on non-limiting embodiments illustrated by the drawings wherein:

FIGS. 3*a* and 3*b* show on the one hand in vertical sectional view the base plate fixed to the ground and the starting block fixed on the base plate and on the other hand a horizontal sectional view at the base plate showing the arrangement of the electronics in the base plate for the detection in particular of any false start according to the invention.

DETAILED DESCRIPTION OF THE INVENTION

In the following description, the well-known elements of a base plate for a starting block, will only be related in a simplified way.

Figure 1:
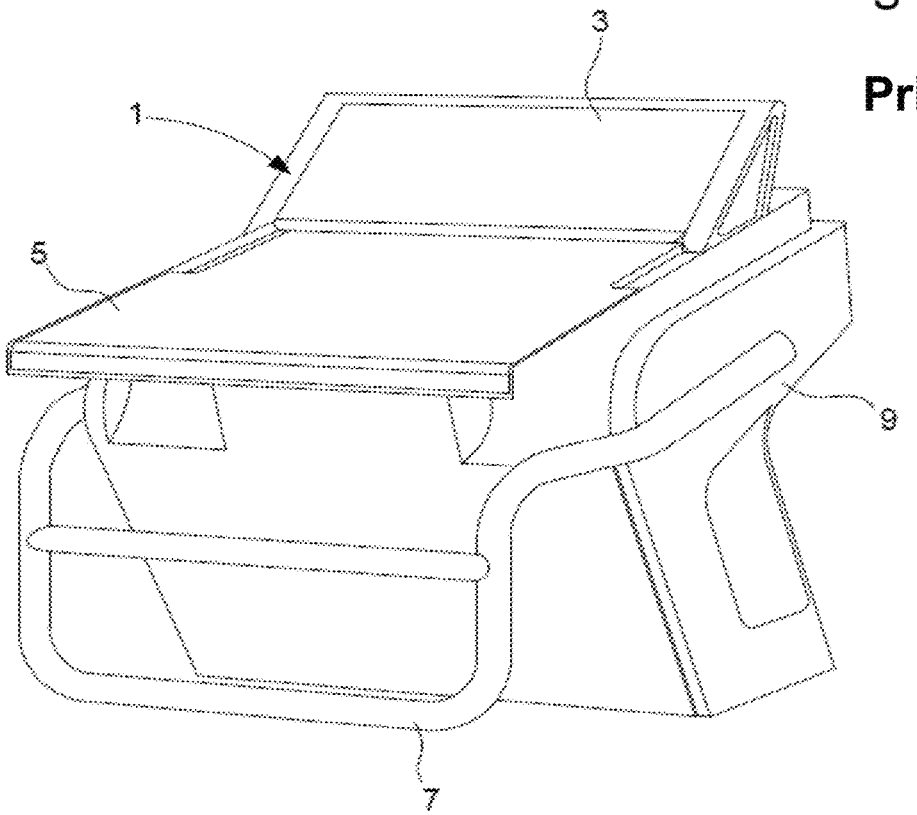
Fig. 1 Prior Art
FIG. 1 shows a standard starting block fixed directly on the ground at the edge of a swimming pool according to the prior art.
Figure 2:
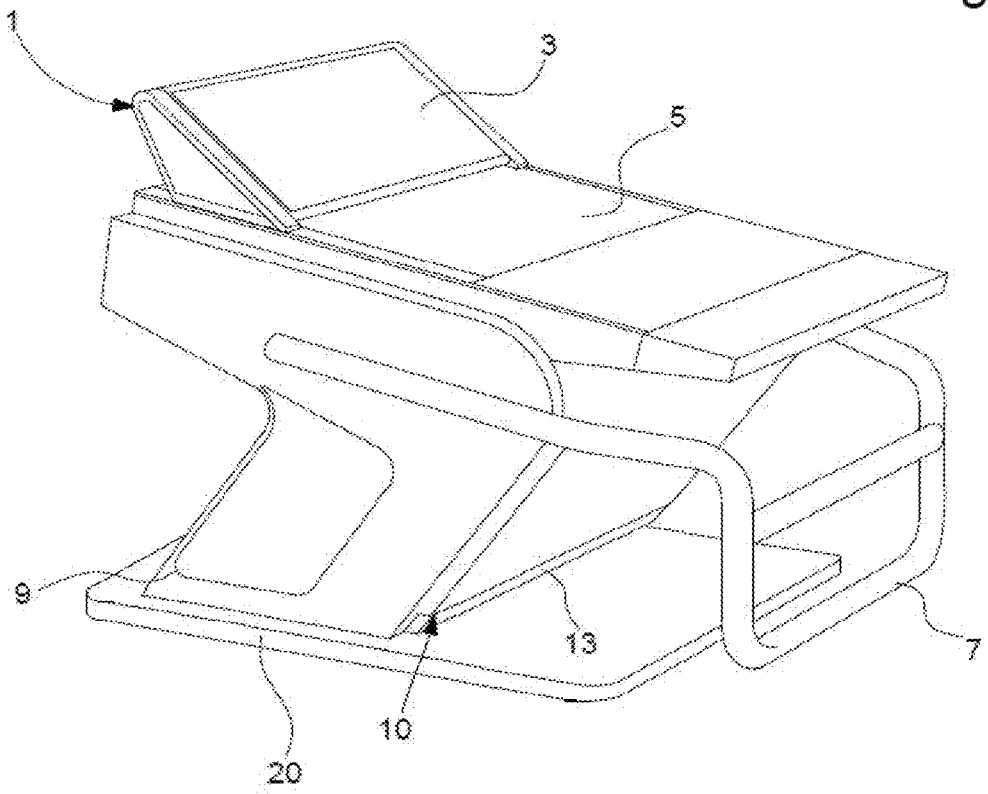
FIG. 2 shows one embodiment of a base plate fixed on the ground at the edge of a swimming pool and on which a starting block is mounted according to the invention.

FIG. 2 shows one embodiment of an assembly consisting of a base plate 20 fixed to the ground with a starting block 1 fixed on the base plate 20. The base plate 20 comprises inside or in an inner cavity an entire system of integrated measurement electronics or technology. This integrated measurement electronics or technology makes it possible to measure certain parameters required for the swimming race. These parameters relate to the reaction time, the detection of the first movement, the time on the block and the analysis of the force during the start.

The measurement electronics essentially comprise at least one force or motion sensor or a strain gauge, disposed preferably at the inner centre of the base plate 20 and not shown in FIG. 2. The sensor or the strain gauge can be connected between a bottom and a cover of the base plate 20, or between a recess in the lower portion and an upper face in the upper portion closing the recess. The signal(s) generated by the sensor or the strain gauges according to at least one measurement direction are provided to a processor processing unit described below of an electronic circuit. The various measurement parameters can be established in each base plate 20 with a power supply for example provided from the outside, so as to be able to supply with the same voltage source all of the base plates disposed in a line on one side or two opposite sides of the swimming pool. However, a transmission of measurement signals can be performed wirelessly or wired from the measurement electronics to a synchronisation room.

The starting block 1 can be a standard starting block that comprises a platform 5 and an inclined plane 3 to the rear of the platform 5, and a base 9 for fixing on the base plate 20 at the edge of the swimming pool. The starting block 1 also comprises a structure in the form of bars 7, fixed to the base 9 or to the platform 5 on the base 9 to be held by the hands of a swimmer for a backstroke swimming race. The starting block can also comprise a supporting ledge device 10 equipped with a supporting ledge 13 to receive in the water the feet of a swimmer before the start of a backstroke swimming race. The supporting ledge 13 is connected to at least one strap to be pulled out of the water in a stowed rest position as opposed to an elastic or return spring intended to push the supporting ledge 13 in the direction of the water for a backstroke swimming race.

The measurement electronics in the base plate 20 can comprise a plurality of first force or motion sensors or a plurality of strain gauges 26. Preferably, four first force or motion sensors or four first strain gauges 26 are provided as shown in FIGS. 3*a* and 3*b* described below. The four first sensors 26 or first gauges 26 are each respectively disposed in one of the four inner corners of the base plate 20. All of the first sensors are connected to the processor processing unit 29 to provide measurement signals. A processing of the signals in the processing unit 29 is performed to determine the various measurement parameters to be stored in the electronic circuit and/or to be transmitted to a base station for managing the swimming race wirelessly or wired.

It should be noted that in the case of a circular-shaped base plate 20, the sensors or the gauges 26 are disposed at a distance from one another and can form a square once positioned in the base plate 20. However, at least two sensors or gauges 26 or more than four sensors or gauges 26 can be provided all connected to the processor processing unit 29.

The measurement electronics in the base plate 20 can also comprise at least one second force or motion measuring sensor or at least one second strain gauge so as to be able to perform a measurement and provide at least one measurement signal according to a direction perpendicular to one or two measurement directions of the first measuring sensors or first strain gauges 26. Preferably, the signals generated by the first and second measuring sensors or strain gauges are established according to three measurement directions perpendicular to one another. At least one of the sensors or strain gauges must be three-dimensional sensors for measurements in three different directions.

FIGS. 3*a* and 3*b* show the assembly consisting of the base plate fixed to the ground by the first fixing means 28, and of the starting block 1 fixed on the base plate 20 by second fixing means 27. Preferably, the first fixing means 28 and the second fixing means 27 each consist of screws and internal threads. It is shown for the first fixing means, four first screws 28 to be screwed into four corresponding internal threads, and for the second fixing means, four second screws 27 to be screwed into four corresponding internal threads. Of course, more or less screws and internal threads can be provided.

For placing all of the measurement electronics inside the base plate 20, as well as fixing the base plate 20 on the ground at the edge of the swimming pool, the base plate 20 consists of two portions to be fixed on one another. Preferably, the base plate 20 comprises a bottom in the lower portion surmounted by a cover in the upper portion, or a recess in the lower portion and an upper face in the upper portion closing the recess, not shown in detail in FIGS. 3*a* and 3*b*.

The bottom or the recess in the lower portion comprises openings for passing through the threaded rods of the screws 28 and optionally a slot for each screw head 28 on the inner side of the base plate 20. Each opening is of slightly larger diameter than each threaded rod of the screws 28, but smaller than the diameter of each screw head. Each threaded rod of the screws 28 is inserted through the opening produced in the bottom or the recess so as to be screwed into a respective internal thread produced in the ground for placing the base plate 20. Of course, the internal threads are positioned depending on the location of all of the openings produced in the bottom or the recess for passing through the threaded rods of the fixing screws 28. Thus after having screwed each screw 28 into the respective internal thread produced in the ground, the bottom or the recess is securely fixed in the desired location for placing the base plate 20 with each screw head pressing the bottom or the recess against the ground. Subsequently, a cover is fixed on the bottom, or an upper face is fixed on the recess so as to completely close the base plate 20, which comprises all of the race parameter measurement electronics. The fixing of the two portions of the base plate must be performed in principle by mechanical means in order to be easily dismantled.

It should be noted that the two portions of the base plate 20 can on the one hand be mounted on one another and also fixed directly on the ground by the same screws 28, the threaded rod of which passes through an opening on the upper side and an opening on the lower side before being screwed into the corresponding internal thread in the ground. Thus a single screw 28 can already make it possible to fix the two portions therefore of the base plate 20 directly to the ground. In this case longer screws must be provided in numbers equal to the number of internal threads provided in the ground to fix the base plate 20.

The upper portion, which can be the cover or the upper face, is fixed on the lower portion, which can be the bottom or the recess, to constitute the base plate 20. After fixing the base plate 20 to the ground, the upper portion of the base plate 20 comprises internal threads for fixing the starting block 1. The bottom of the base 9 of the starting block 1 comprises openings for passing through the threaded rods of screws 27, which constitute the second fixing means. The passage openings are arranged depending on the location of the internal threads produced in the upper portion of the base plate 20. As the starting block 1 consists of a base 9 with side walls that can be opened, it is easy to screw the second screws 27 by passing through each respective opening, into the corresponding internal threads in the upper portion of the base plate 20. Thus the screw heads once screwed into the internal threads press the bottom of the starting block 1 against the base plate 20.

As a reminder, the measurement electronics shown in the base plate 20 preferably comprise at least four force sensors 26 or four strain gauges 26, disposed near four corners of the base plate 20 and each connected to the inner lower portion and to the inner upper portion of the base plate 20. Each sensor or gauge 26 provides a measurement signal to a processor processing unit 29, which can be part of an electronic circuit, which also comprises means for storing measurement results or data processed by the processing unit. The processor processing unit 29 is in principle housed inside the base plate 20, but can also be provided to be fixed to the outside of the base plate 20. An oscillator for setting the clock speed of the operations can also be integrated into the electronic circuit to set the clock speed of all of the operations of the processing unit 29. The stored measurement results can subsequently be communicated wirelessly or wired to a base station or timing station for synchronising the results. Thanks to the measurement electronics disposed inside the base plate 20, the measurement signals are processed in the processing unit 29 by algorithms adapted to calculate the specific metric values to be sent to the base station or to the synchronisation station. The measurement parameters determined can be the reaction time on the starting block of the swimmer at the time of the start of a race, so as to detect any false start. The measurement parameters can also be used to calculate for example the power and the speed of the athlete during the start. As means for fixing the upper portion on the lower portion, the strain gauges can also be used to hold the two portions against one another.

Other fixing means can be provided to fix on the one hand the base plate 20 on the ground and on the other hand the starting block 1 on the base plate 20. The base plate 20 can be pressed into a corresponding slot produced in the ground in the extension of a race lane facilitating its placement. Plates for holding the base plate 20 in its slot are fixed to the ground.

It can also be provided that the first fixing means consist of on the one hand plates fixed by the rods under the lower portion of the base plate 20, so as to be inserted by sliding into grooved parts produced at the location provided for the base plate 20. The number of plates and their position correspond to the number of grooved parts produced and to their position in the ground. As soon as the plates are positioned in their respective groove the grooves are closed.

It should be noted that the second fixing means can be identical to the first fixing means as indicated above. In addition, all of the first and second force or motion sensors or first and second strain gauges are mounted free to move about a pivot to provide measurement signals in one or more directions to the electronic circuit, which further comprises an oscillator to set the clock speed of the operations of the processor processing unit.

Based on the description that has just been given, a plurality of variants of the base plate for a starting block having swimming race parameter measurement electronics, can be produced without departing from the scope defined by the claims.

The invention claimed is:

1. A base plate to be fixed to the ground at an edge of a swimming pool and on which a starting block can be fixed, the base plate comprising:

an upper portion and a lower portion that are directly connected to form an inner cavity, and in the inner cavity, measurement electronics with at least one force or motion sensor or at least one strain gauge, to provide a measurement signal according to a location of the starting block to a processor processing unit to determine one or more race parameters and/or to communicate wirelessly or wired to a base station or a timing station, wherein the upper portion includes a planar upper face and the planar upper face includes internal threads configured to receive screws extending downward from a lowest surface of the starting block.

2. The base plate according to claim 1, wherein the at least one force or motion sensor or at least one strain gauge of the measurement electronics comprises a force or motion sensor or a strain gauge, disposed in a central position of the base plate to provide the measurement signal to the processor processing unit of an electronic circuit, which processes the measurement signal to determine the one or more race parameters, and the electronic circuit is configured to store result(s) obtained from the measurement signal.

3. The base plate according to claim 1, wherein the at least one force or motion sensor or at least one strain gauge of the measurement electronics comprises a plurality of first force sensors or first strain gauges disposed near corners of the base plate.

4. The base plate according to claim 1, wherein the at least one force or motion sensor or at least one strain gauge of the measurement electronics comprise at least four first force sensors or at least four first strain gauges disposed near four corners of the base plate to provide the measurement signal in at least one direction or two perpendicular directions, and an electronic circuit is configured to store result(s) obtained from the measurement signal.

5. The base plate according to claim 1, further comprising screws to fix the base plate to the ground, wherein a threaded rod of each of the screws passes through a respective opening of the lower portion of the base plate to be screwed into a respective internal thread produced in the ground at the edge of the swimming pool.

6. The base plate according to claim 5, wherein the lower portion comprises at least four openings of diameter slightly larger than each threaded rod of the screws, said openings being positioned like the location of the internal threads in the ground before receiving each screw for fixing the base plate on the ground, once screwed into their respective internal threads, a head of each of the screws presses the lower portion of the base plate against the ground to fix the base plate on the ground.

7. The base plate according to claim 1, wherein the base plate includes four of the internal threads to receive four of the screws, and a threaded rod of each of the screws is configured to pass through a respective opening at a bottom of a base of the starting block to be screwed into one of the internal threads.

8. The base plate according to claim 7, wherein once the four screws are screwed into their respective internal threads, a head of each of the four screws is configured to press the bottom of the base of the starting block against the upper portion of the base plate.

9. An assembly comprising:

a base plate to be fixed to the ground at an edge of a swimming pool; and a starting block fixed on the base plate, the starting block including a platform, an inclined plate to a rear of the platform, a base extending downward from the platform, and bars fixed to the base or the platform, wherein the base plate comprises an upper portion and a lower portion that are directly connected to form an inner cavity, and in the inner cavity, measurement electronics with at least one force or motion sensor or at least one strain gauge, to provide a measurement signal according to a location of the starting block to a processor processing unit to determine one or more various race parameters and/or to transmit the measurement signal wirelessly or wired to a base station or a timing station, and wherein the upper portion includes a planar upper face and a lowest surface of the starting block is fixed to the planar upper face.

* * * * *